United States Patent [19]

Maestrami

[11] 4,415,186

[45] Nov. 15, 1983

[54] FLANGING SYSTEM FOR SUSPENDING CASTING AND TUBING COLUMNS FOR HIGH PRESSURE OIL OR GAS WELLS

[75] Inventor: Marino Maestrami, Piacenza, Italy

[73] Assignee: Saipem S.p.A., Milan, Italy

[21] Appl. No.: 214,797

[22] Filed: Dec. 9, 1980

[30] Foreign Application Priority Data

Feb. 19, 1980 [IT] Italy ..... 20003 A/80

[51] Int. Cl.[3] ..... E21B 19/10

[52] U.S. Cl. ..... 285/142; 285/144

[58] Field of Search ..... 285/142, 140, 143, 141, 285/144

[56] References Cited

U.S. PATENT DOCUMENTS

| | | | |
|---|---|---|---|
| 1,680,900 | 8/1928 | McQuaid | 285/143 X |
| 2,087,179 | 7/1937 | Barker | 285/142 |
| 2,207,255 | 7/1940 | Jesson et al. | 285/143 |
| 2,274,477 | 2/1942 | Howard et al. | 285/140 X |
| 2,517,821 | 8/1950 | Allen | 285/142 |

*Primary Examiner*—Thomas F. Callaghan

*Attorney, Agent, or Firm*—Hedman, Casella, Gibson, Costigan & Hoare

[57] ABSTRACT

A flanging system for suspending casing and tubing columns for very deep, high pressure oil or gas wells having superimposed spools with adjacent outer flanges for joining the spools, and hangers having axial cylindrical bores therethrough. The spools include inner annular horizontal projections and depending frusto conical portions and the hangers have corresponding outer horizontal annular projections which rest on the inner projections of the spools and complimentary depending frusto conical shapes for positioning within the spools. The lower ends of the hangers are threaded for connection to the columns. In addition, the system has inner and outer seals, wherein the inner seal includes an annular steel ring in a seat in the top of the hanger and a counter seat in the spool immediately above the hanger, and wherein the outer seal includes an annular metal gasket between the projections and preferably annular gaskets in the frusto conical portion of the hangers.

4 Claims, 4 Drawing Figures

FLANGING SYSTEM FOR SUSPENDING CASTING AND TUBING COLUMNS FOR HIGH PRESSURE OIL OR GAS WELLS

This invention relates to a flanging system of relatively simple construction for suspending casing and tubing columns for very deep, high pressure oil or gas wells.

BACKGROUND OF THE INVENTION

It is well known that oil wells include various casing and tubing portions disposed one inside the other and opening at the surface at slightly different levels inside a well head, the purpose of which is to support them in their determined position.

The well heads are formed from a number of flanged spools mounted on each other, their purpose being to support a casing or tubing column while at the same time maintaining a hermetic inner and outer seals between one column and the other and between the columns and the surrounding environment.

FIG. 1 shows typical flanging systems of the known art. The two lower systems are used for suspending casing columns, and the upper system is used for suspending tubing columns. Each of the two lower flanging systems has:

(a) two superposed spools 1 having an inner diameter suitable for the casing to be hung 2, and having an internal conicity which is calculated as a function of the weight to be supported;

(b) a set of positioning wedges 3 arranged to support the casing column 2 and calculated as a function of the weight of the column;

(c) a primary gasket pack, the purpose of which is to seal the casings relative to the surrounding environment, and which includes a rubber ring 5 compressed between two iron rings 6 of trapezoidal cross-section which cause the rubber ring to adhere to the outer surface of the casings 2, and to the inner surface of the spools 1 when two spools are clamped together by means of stay bolts or clamps;

(d) a smaller secondary gasket pack 7 housed below the overlying support spool for the next column, its purpose being to form the inner seal for the column using the same elements;

(e) a joint ring 8 compressed between two overlying spools, its purpose being to ensure the inner and outer seal should there be any defect in the gaskets.

The upper flanging system includes the spool 1 and the production cover 9, in which there is disposed a tubing hanger 10 which is internally threaded at its ends. The last tube 11 of the tubing column is screwed to the lower end of the hanger, this column thus remaining suspended from the hanger.

The outside of said hanger is constituted by a cylindrical surface which at its upper and lower ends has a smaller diameter than the diameter of its central part.

An annular rubber gasket 12, a cylindrical ring 13 slidable on said surface and having its lower edge bevelled, and a threaded retention ring 14 are disposed on the lower cylindrical surface. When the hanger is lowered into its seat inside the cover 9 by means of a handling tube screwed to its upper end, it causes the bevelled edge of the slidable ring 13 to rest on a corresponding projection of its seat, and the rubber gasket 12 becomes compressed and expanded outwards, to form the outer seal. The inner seal is formed by a safety valve screwed into the hanger.

Besides the type of suspension for the tubing heretofore described, there obviously exist other more or less sophisticated types, all of which however make their outer seal by means of rubber elements.

The first type of flanging system has considerable drawbacks both with regard to the seal provided by the gasket packs, and with regard to the fitting of the fixing wedges and the centering of the casing.

This is because the rubber rings 5 compressed between the two iron rings are subjected to rapid wear by virtue of the passage of time and the high temperatures, and often cannot resist the high pressures which arise in certain wells. In addition, the positioning wedges and the said gasket packs which are strongly compressed against the outer circumference of the casing can cause it to fracture when, because of the various passages of the rod joints and of the rotation of the drive rod which slides against the inner walls of the casing, these walls become thin to the extent that they become weakened.

Finally, in order to fit the positioning wedges, to centre the casing and to then assemble the gasket packs, it is necessary to dismantle and remove the blow-out preventers (or BOPS) twice, with considerable loss of time and high operating costs.

In this respect, the main operations which have to be carried out for this type of flanging system each time a portion of well has to be cased are as follows:

(a) 1st cementation stage
(b) dismantling and lifting the BOPS
(c) fitting the fixing wedges for centering the column
(d) lowering the reassembling the BOPS
(e) 2nd cementation stage
(f) dismantling and lifting the BOPS
(g) installing the gasket packs
(h) mounting the upper spool 2
(i) reassembling the BOPS The second type of flanging system for suspending tubing columns has drawbacks, especially with regard to the outer seal.

This is because at the high pressures and temperatures, the rubber ring and sliding ring become worn and deform rapidly, because of which the seal becomes weakened or becomes completely lacking.

SUMMARY OF THE INVENTION

The object of the present invention is to provide a new type of flanging system which obviates the drawbacks of known flanging systems. It is suitable both for supporting casings, and (with some slight modification) for supporting tubings.

The flanging system for the casing columns includes a plurality of spools. Each spool has a bore therethrough, the surface of which includes an inner annular projection at the upper ends and a depending frusto conical shape. Externally the spools have flanges at the upper and lower ends which are joined together to form the superimposed spools. In each pair of superimposed spools, the upper spool has an annular counter seat in the bottom thereof for receiving a sealing ring. Within each spool there is a hanger having a lower end which is threaded for connecting a casing or tubing column thereto, and an outer surface having an outer horizontal annular projection which rests upon the corresponding inner horizontal annular projection of the spool and a depending frusto conical portion which is complimentary to and is received by the frusto conical portion of the bore.

In addition to the self-centering hangers, the present invention includes an inner and outer sealing system. The inner seal includes an annular upper seat in the top of the hanger which opposes the counter seat in the spool thereabove, and an annular steel sealing ring in the seat and counter seat. The outer seal includes a metal annular gasket which rests between the projections in the spool and on the hangers, and preferably annular sealing gaskets in the outer frusto conical portion of the hanger.

In practice the steel rings of the inner seals are squeezed to facilitate sealing upon joining adjacent spools while the inner seals are squeezed to facilitate sealing by the weight of the columns.

DESCRIPTION OF THE DRAWINGS AND DETAILED DESCRIPTION OF THE INVENTION

The following is a brief description of the drawings and a detailed description of a preferred embodiment of the invention. It is to be understood that the invention is capable of modification and variation apparent to those skilled in the art within the spirit and scope of the invention.

In the drawings:

FIG. 1 is a longitudinal perspective view, partly in section, of a flanging system of the prior art.

FIG. 2 is a section through two flanging examples according to the invention, one with a hanger 2 for a casing 6, and one with a hanger 8 for a tubing 9.

Figure 1:
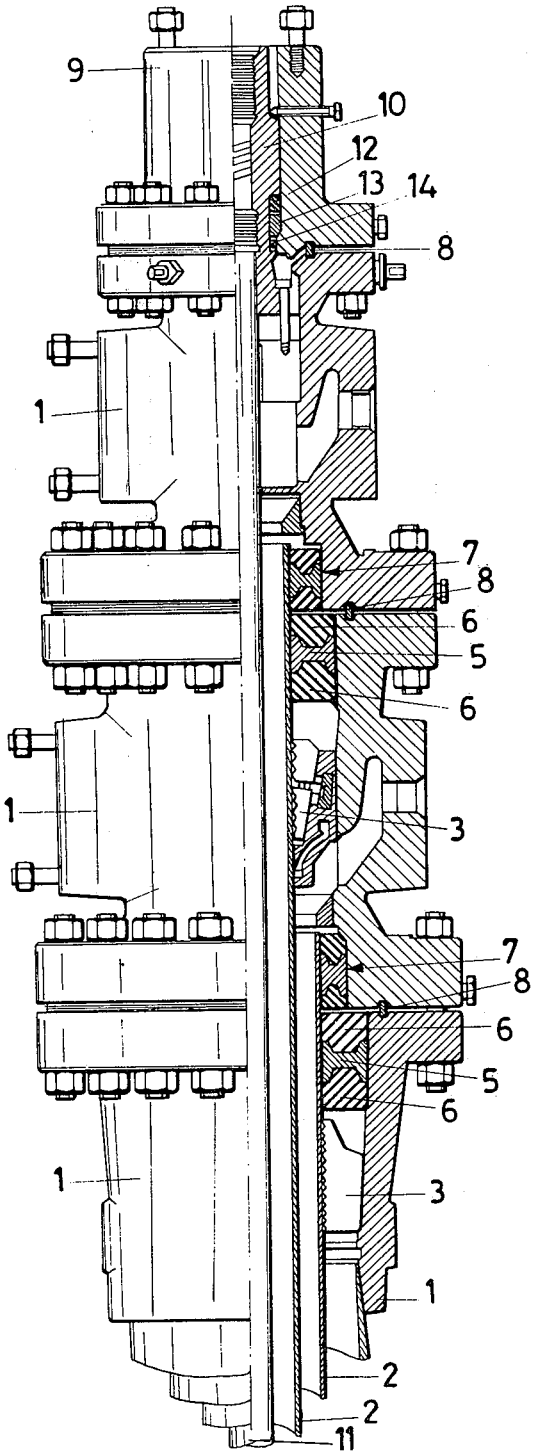
Figure 2:
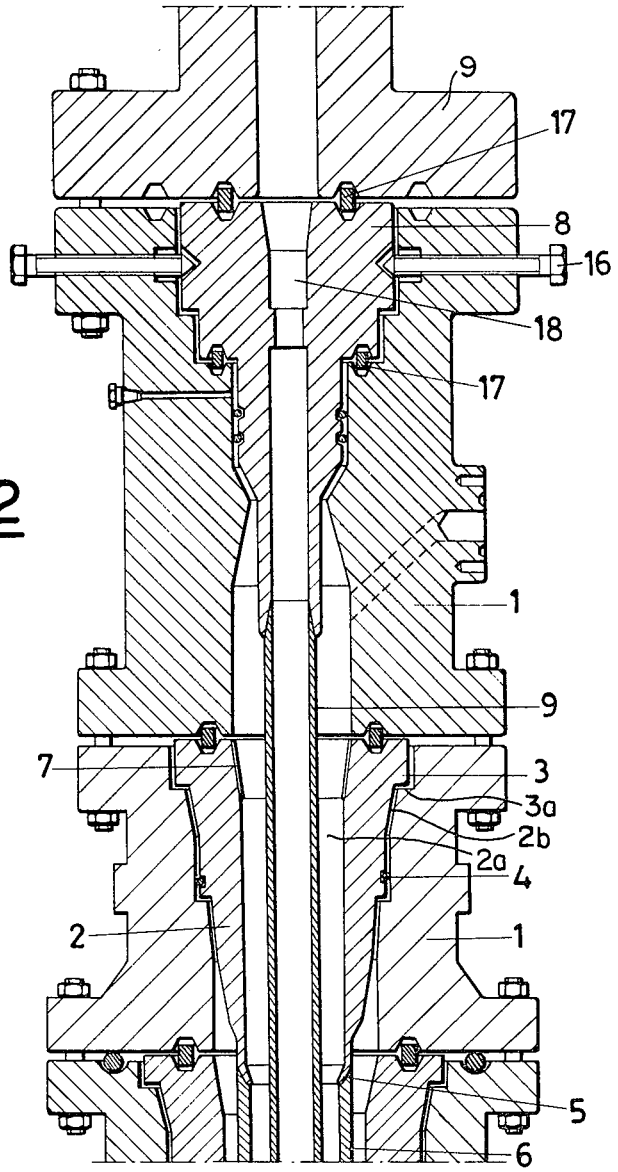

Referring to FIG. 2, the flanging system according to the present invention has two overlying flanged spools 1, and a hanger 2 with a cylindrical bore 2*a* and frusto-conical outer surface 2*b* provided with an annular projection 3 which rests on a corresponding projection 3*a* provided on the inner parts of the lower spool, 1 and annular grooves 4 acting as seats for suitable seal gaskets.

The lower end 5 of said hanger 2 is threaded externally or internally for connection to the casing 6 to be supported, while the upper end 7 of the hanger 2 is threaded internally for connection to the handling tube not shown used for inserting and positioning the hanger inside the spool.

Figure 3:
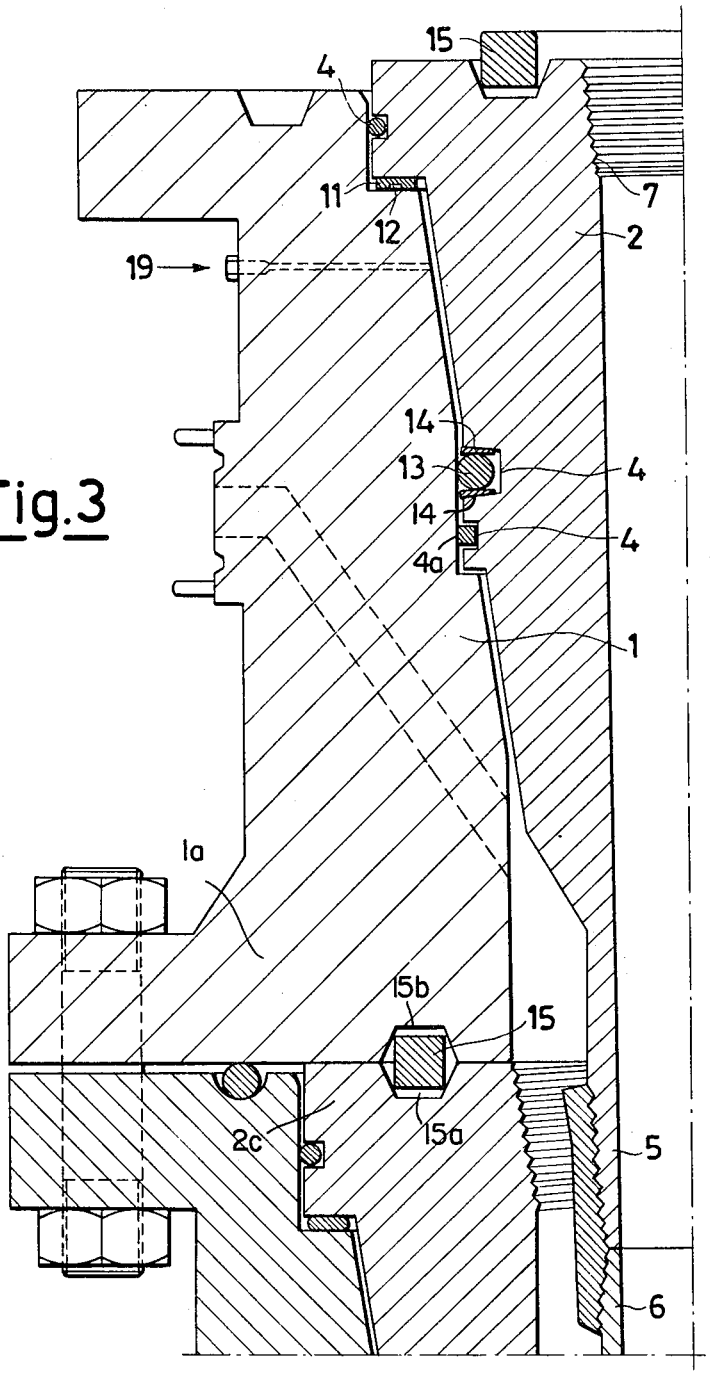
FIG. 3 is a detailed view of a flanging system with a casing hanger.

The outer seal (see FIG. 3) for the hanger 2 is provided by an annealed annular copper gasket 11 fixed to the annular projection 3 by screws 12, a rubber gasket 13 inserted into the annular groove 4 and compressed between two rings 14 of special material in the form of a wedge which aids the seal, and other rubber O-rings 4*a* inserted into the remaining annular grooves 4. The inner seal is provided by a special steel ring joint 15 which has its seat 15*a* in the top 2*c* of the hanger and its counter-seat 15*b* in the bottom 1*a* of the next spool 1. The weight of the casing column squeezes the rubber gasket 13 with an increase in the outer seal, whereas the stay bolt connection between the two flanges of the upper and lower spools squeezes the ring 15 to provide the inner seal.

Figure 4:
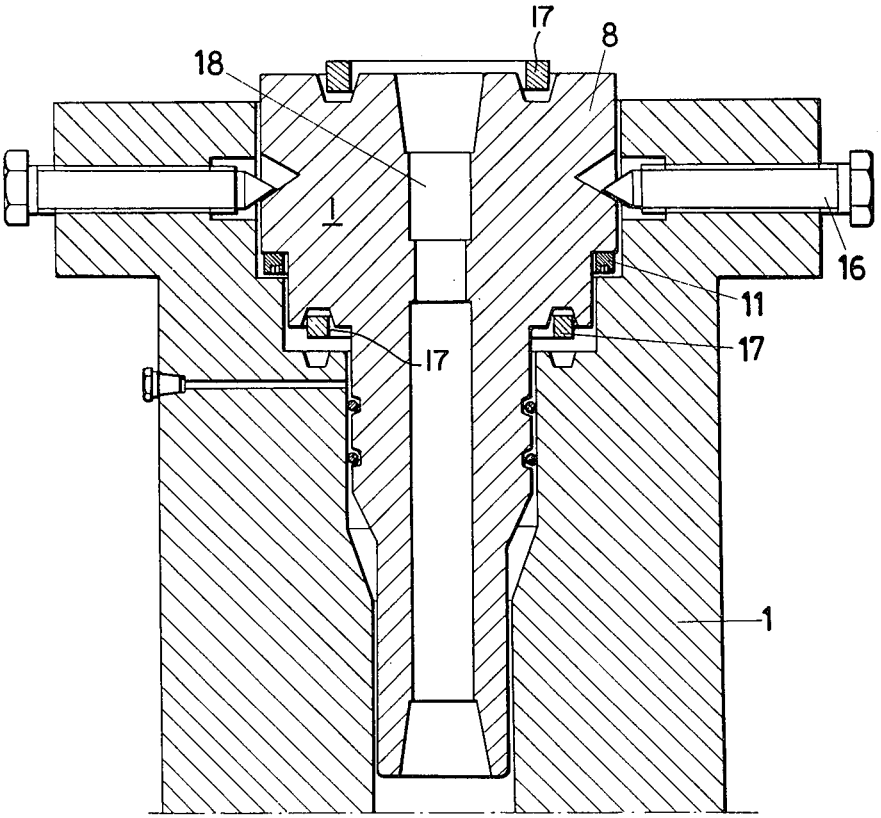
FIG. 4 is a detailed view of a flanging system with a tubing hanger in the position assumed during the dismantling of the BOPS, i.e. before it assumes the final position indicated in FIG. 2.

The hanger 8 for the tubing a (FIG. 2) differs from the casing hanger 2 because both the outer and inner seals are provided by steel ring joints 17. The copper gasket 11 indicated in FIG. 4 is used only to provide the outer seal during the dismantling of the BOPS. Before assembling the production cover, the hanger 8 is lifted and the copper gasket 11 is removed, so entrusting the outer seal only to the lower steel ring joint 17.

Even with these differences, the concept on which the present invention is based remains unchanged, i.e.:

(1) flanging system with the outer seal provided by means of an annular projection on the hanger which rests on a copper or steel gasket, which in its turn rests on a corresponding annular projection provided on the inner part of the spool, (2) flanging system with the inner seal provided by means of a special steel ring joint which has its seat in the top of the hanger, and its counter-seat in the bottom of the upper spool.

The purpose of the screws 16 shown in FIG. 4 is to retain the hanger 8 against the internal pressure as, the lowering of the tubing is terminated and the BOP is dismantled and lifted for connecting the upper flange of the last spool 1 to the lower flange of the production cover.

With the described type of hanger, according to the present invention, the flanging procedure involved in suspending casing or tubing columns becomes more simple, more rapid, more reliable and stronger than those of the known art. In this respect, when a well portion of determined diameter has been terminated, it is cased with casing tubes, and the hanger, with the copper, steel and rubber gaskets already inserted into their respective seats, is screwed to the end of the last tube. A handling tube is screwed to the upper end of the hanger, and is used for lowering the support into its seat provided in the last spool. About one tenth of the weight of the casing column is allowed to act on said seat, and the lower end of the casing column is then cemented through the lateral apertures in the spool. The entire weight of the column is then released, and the upper end of the column is then cemented. The BOPs are then lifted, and the upper spool is then assembled, to which the next casing column is to be fixed. A sealing test is carried out on the gaskets through the test bore 19 (FIG. 3), and the BOPs are reassembled. The same procedure is carried out for each casing column until the last column is reached, i.e. the tubing column. The hanger for this latter column with its copper, steel and rubber gaskets inserted in their respective seats and the safety valve installed in the central bore is lowered on to its seat using the same procedure as for the casing hangers, so that it assumes the position shown in FIG. 4.

In this position, the outer seal is provided by the copper gasket 11, and the inner seal is provided by the safety valve 18. To prevent any inner pressure pushing the hanger upwards during the lifting of the BOPS, it is locked by means of the lateral screws 16 incorporated in the upper flange of the last spool.

The handling tube is then removed, and the BOPS are then lifted. The handling tube is re-screwed to the upper end of the hanger, the hanger is released from the lateral screws 16, is lifted rapidly and the copper gasket is removed, after which it is again lowered into its seat so that the weight of the tubing acts on the steel ring joint 17, assuming the position shown in FIG. 2. The flange of the last spool is then connected to the flange of the production cover, the screws 16 are again screwed down, and the entire assembly is tested at the operating pressure.

The flanging system according to the present invention therefore has considerable advantages over those of the known art. These can be summarised as follows:

Ease and rapidity of assembly, in that because of the shape of the hanger, centering of the casing or tubing is automatic, and the BOPS are lifted only once for assembling the upper spool. Greater gasket resistance to the high pressures and temperatures, with consequent improved inner and outer seal.

Greater resistance to wear caused by rotation and passages of the drilling rod joints, due to the considerable thickness of the hanger.

Lower constructional and operating costs.

What we claim is:

1. A system for suspending columns for high pressure oil or gas wells within superimposed spools having adjacent flanges thereon for joining the spools and hangers in bores in the spools having axial cylindrical bores therethrough comprising:

a lower spool with the surface of the bore therein including an inner annular horizontal projection at the upper end thereof and a depending frusto conical shape, and an upper spool contiguous therewith having an annular counter seat in the bottom thereof for receiving a sealing ring, and means extending through the adjacent flanges for joining said spools together, a hanger within said lower spool having a lower end which is threaded for connecting a column thereto, an upper end which is threaded for connecting a hanging tube thereto, and an outer surface between said ends which has a frusto conical shape that is complimentary to and is received by said frusto conical portion of said bore in said spool with an outer horizontal annular projection at said upper end which rests upon said corresponding inner annular projection of said lower spool, an outer seal including an annular gasket made from a metal selected from the group consisting of copper and steel which rests between said projections, an annular groove in the outer frusto conical surface of said hanger, and an annular sealing gasket in said groove wherein the weight of the column squeezes said gasket to facilitate sealing, and an inner seal including an annular upper seat in the top of said lower spool which opposes said counter seat in said spool thereabove and a steel ring joint in said seat and counter seat which is squeezed to provide sealing as said spools are joined together.

2. The system according to claim 1, wherein said outer seal includes a pair of wedge shaped annular rings above and below said annular gasket in said annular groove to further facilitate sealing.

3. The system according to claim 2, including:

a cover having a flange at its lower end and an annular counter seat therein in the bottom thereof for receiving a sealing ring, and wherein said upper spool with the bore therein includes an inner projection in the upper portion thereof, and an annular seat therein in the top thereof opposing said counter seat for receiving a sealing ring, a hanger within said upper spool having a lower end which is threaded for connecting a column thereto, and an outer annular projection at the upper portion thereof which rests upon said corresponding inner annular projection of said upper spool, an outer seal including annular seat and counter seat in said projections and an annular steel ring in said seat and counter seat, and an inner seal including an annnular ring in said seat and counter seat of said upper spool and cover.

4. The system according to claim 3, wherein there are a pair of said lower spools with said hangers therein having casings depending therefrom and said upper spool and hanger therein having a tubing depending therefrom.

* * * * *